US006174266B1

(12) United States Patent
Merrill

(10) Patent No.: US 6,174,266 B1
(45) Date of Patent: Jan. 16, 2001

(54) PLAYGROUND EQUIPMENT

(76) Inventor: John E. Merrill, 2058 Morgan Frederick Grade, Cross Junction, VA (US) 22625

( * ) Notice: Under 35 U.S.C. 154(b), the term of this patent shall be extended for 0 days.

(21) Appl. No.: 09/240,051

(22) Filed: Jan. 29, 1999

Related U.S. Application Data

(60) Provisional application No. 60/073,414, filed on Feb. 2, 1998.

(51) Int. Cl.[7] ..... A63B 9/00

(52) U.S. Cl. ..... 482/35; 5/127; 248/431; 403/176; 403/217

(58) Field of Search ..... 482/23, 27–29, 482/35, 37, 69; 182/137–140, 150; 52/222; 5/120, 122, 123, 127–130; 297/DIG. 11; 248/94, 165, 431, 432; 135/100, 156; 403/176, 179, 217

(56) References Cited

U.S. PATENT DOCUMENTS

| | | | | |
|---|---|---|---|---|
| 34,258 | * | 1/1862 | Lynch | 135/100 |
| 974,491 | * | 11/1910 | Huebner | 135/100 |
| 1,866,175 | * | 7/1932 | Rogers, Jr. | 248/168 |
| 2,663,306 | * | 12/1953 | Davis | 135/100 |
| 2,843,379 | | 7/1958 | Merritt . | |
| 3,547,435 | | 12/1970 | Scott . | |
| 4,340,217 | | 7/1982 | Gillis . | |
| 5,070,665 | | 12/1991 | Marrin et al. . | |
| 5,330,400 | | 7/1994 | Huberman . | |
| 5,356,354 | | 10/1994 | Owens . | |

FOREIGN PATENT DOCUMENTS

| | | |
|---|---|---|
| 1812593 | 6/1970 | (DE) . |
| 2310787 | 12/1976 | (FR) . |

* cited by examiner

*Primary Examiner*—John Mulcahy
*Assistant Examiner*—Victor K. Hwang
(74) *Attorney, Agent, or Firm*—Richard C. Litman

(57) ABSTRACT

A play and climbing equipment structure including a support structure with at least three sloping beams that form a vertex where the three beams meet, and that form a polyhedral shape having a triangular shaped bottom. At least one flexible planar surface is positioned within the interior of the support structure and is attached to the sloping beams. A contoured object is placed immediately under the vertex, and restricts the excessive inward movement of the beams, thereby preventing unintended collapse of the structure.

8 Claims, 3 Drawing Sheets

PLAYGROUND EQUIPMENT

CROSS-REFERENCE TO RELATED APPLICATION

This application claims the benefit of U.S. Provisional patent application Ser. No. 60/073,414, filed Feb. 2, 1998.

BACKGROUND OF THE INVENTION

1. FIELD OF THE INVENTION

The present invention generally relates to playground climbing equipment, and more particularly, to a climbing and play structure having a triangular shaped base and horizontally disposed nets positioned at different vertical levels within the structure.

2. DESCRIPTION OF RELATED ART

Children enjoy playing on playground equipment that involves climbing and suspending themselves at in an elevated location. While children find these climbing structures fun and intriguing, such climbing structures are inherently dangerous. Typically, playground climbing equipment involves the interconnection of numerous structural members to form the climbing structure. The prior art describes a variety of climbing and play structures for children, however, none of the prior art climbing structures have the unique and innovative features of the present invention.

U.S. Pat. No. 5,330,400 issued to Joseph Huberman on Jul. 19, 1994 discloses a climbing and play structure. The structure involves a polyhedral shape to which numerous tensile members are interconnected. The tensile members are placed around and within the structure. There is a support surface for the structure, but the structure itself is moveable. The support surface and anchor means to secure the tensile members of the structure severely limits the equipment and adds bulk.

U.S. Pat. No. 2,843,379 issued to Oscar Merritt on Jul. 15, 1958 teaches an amusement apparatus from which children can swing. The equipment provides rigid seats attached by flexible lines situated in a circle around a stationary vertical pole. The flexible lines do not provide a rigid structure. The swinging lines holding the seats limit the equipment's safety and accessibility to many children simultaneously.

U.S. Pat. No. 4,340,217 issued to Robert Gillis on Jul. 20, 1982 describes a monkey maze formed by interconnecting numerous equilateral triangles formed by rods together. There is no support structure within or below the maze to support the fall of a child, no structure to provide a surface for support or security of a child, and no structure for a child to sit on and relax, except for rods that make up the structure.

None of the above inventions and patents, taken either singly or in combination, is seen to describe the instant invention as claimed.

SUMMARY OF THE INVENTION

The present play and climbing equipment invention involves an interconnection of sloping beams that creates an unique structure having attached thereto a flexible net-like substantially planar surface for use by children in a playground setting. One flexible net is preferably horizontally disposed approximately 12 feet above ground level while another, generally larger flexible net is preferably horizontally disposed approximately 6 feet above ground level. The number and height of the flexible net-like substantially planar surfaces can be varied. An important element of the present invention is that a contoured stabilizing piece or object is placed under the vertex formed by the sloping beams and serves to restrict the inward movement of the beams towards one another; such inward movement could result in instability, and eventual collapse of the structure. The increased stability provided by the contoured object means that the climbing and play structure of the present invention does not need to be anchored to the ground, compared to known playground structures that lack the structural features of the present invention, and therefore, typically must be anchored to the ground.

Accordingly, it is a principal object of the invention to provide an outdoor play structure capable of limiting the motion of the vertical beam members that makeup the structure.

It is another object of the invention to provide an outdoor play and climbing structure that invigorates and encourages children to play, experiment and learn, while providing sufficient support to create a safe and stable play environment.

It is an object of the invention to provide improved elements and arrangements thereof in a climbing and play structure for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
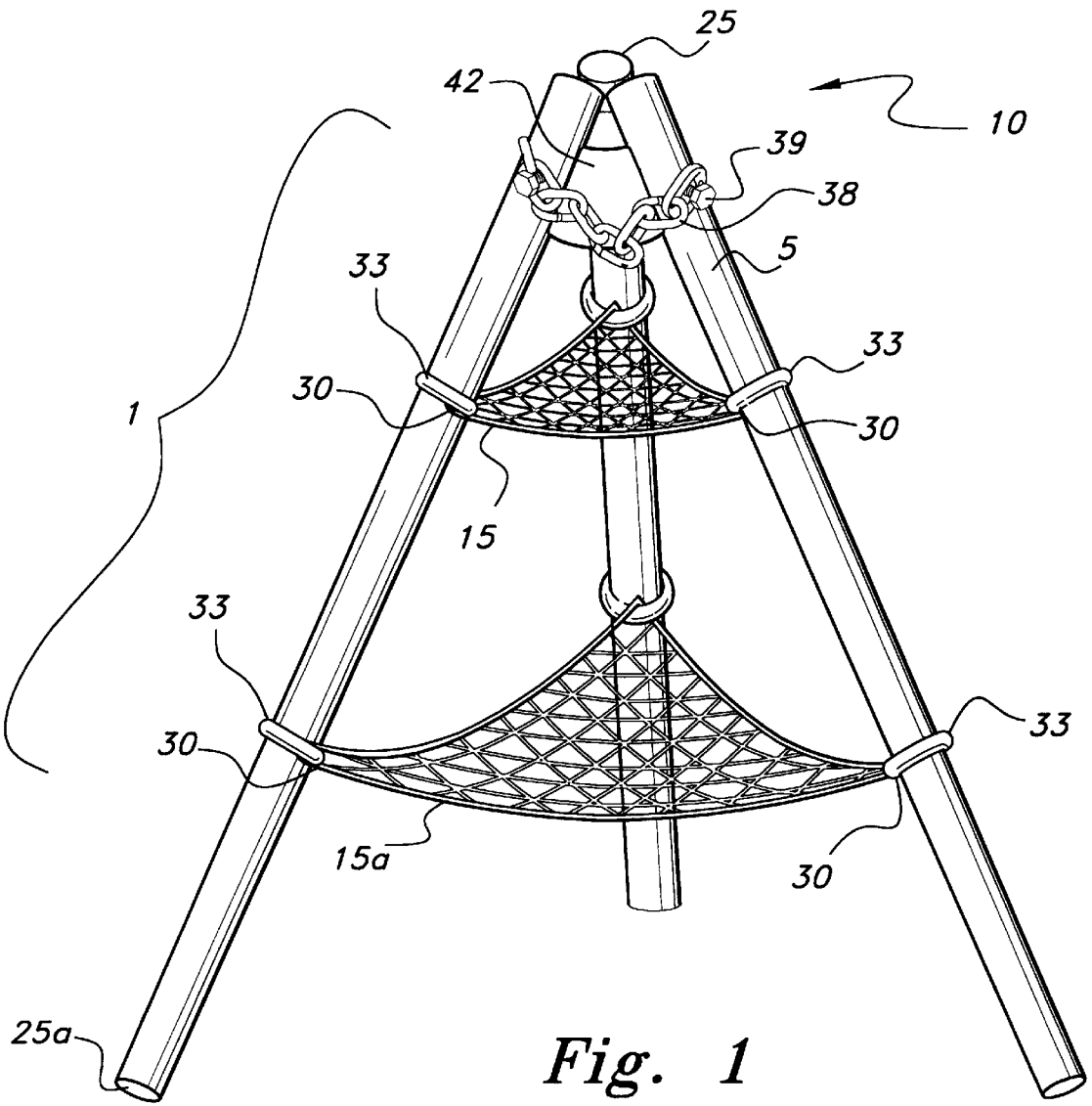
FIG. 1 is an environmental perspective view of one embodiment of a play and climbing equipment structure according to the present invention.

FIGS. 1–4 depict preferred embodiments of the present play and climbing equipment 1 invention comprising an interconnection of three sloping beams 5. The three beams 5 slope toward one another to form a vertex 10 as depicted in FIG. 1. The three sloping beams 5 provide the climbing and play equipment with a tetrahedrally shaped framework having a triangular base. Each beam 5 is preferably approximately 18 feet in length and preferably approximately 8 inches in diameter.

Figure 2:
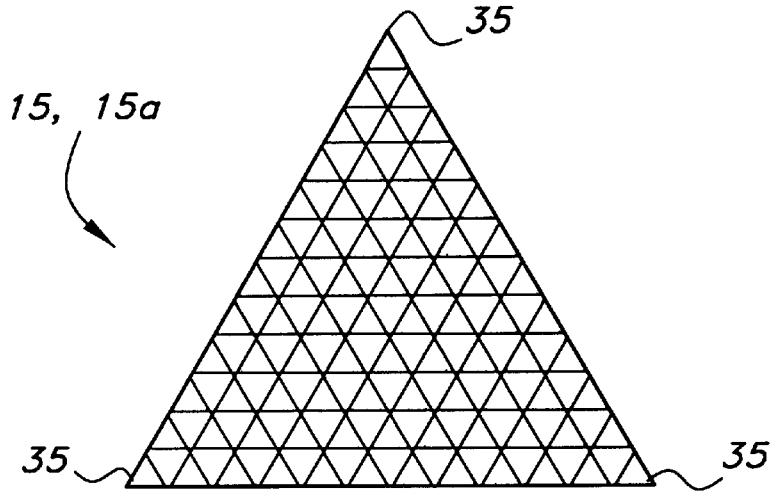
FIG. 2 is a top plan view of a webbed planar surface.

Placed within the sloping beams 5 that form the tetrahedron is a horizontally disposed lower, flexible, substantially planar surface 15*a,* and a horizontally disposed upper, flexible, substantially planar surface 15 collectively referred to herein as flexible planar surfaces (15,15*a*). A preferred embodiment shown in FIG. 2 depicts the flexible substantially planar surfaces (15,15*a*) as each having three corners 35. The three corners 35 of each planar surface (15,15*a*) are connected to the three beams 5 at attachment point 30.

Figure 3A:
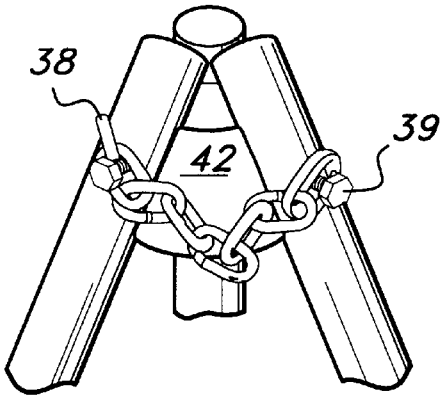
FIG. 3A is a side view that shows a contoured object placed within the play and climbing structure immediately below the vertex formed by three sloping beams.

A contoured piece or object 42, that serves to stabilize the play and climbing structure 1 of the present invention is seated immediately below the vertex 10 and within the tetrahedron structure as depicted in both FIGS. 1 and 3A, provides a critical structural restricting element that restricts the inward movement of the three sloping beams 5. The contoured object 42 is preferably shaped to generally correspond to the dimensions and shape of the vertex 10, such that the contoured object 42 can prevent the excessive inward movement of the beams 5 to positions that could result in the collapse of the play and climbing equipment structure 1. Positioning the appropriately dimensioned contoured object 42 below the vertex 10, as depicted in FIGS. 1 and 3A, prohibits each of the beams 5 from moving excessively inward. Once a beam makes contact with the contoured object 42, the beam is thereby prevented from any further inward movement.

The play equipment 1 includes a support structure constructed from at least three sloping beams 5, each beam 5 has a lower portion with a corresponding bottom end 25*a,* and an upper portion with a corresponding top end 25. The upper portion of the three beams 5 slope towards one another to form a vertex 10. In a preferred embodiment, the overall shape of the structure of the play equipment 1 is tetrahedron, having a triangular shaped bottom. However, numerous other multiple sided structures can be constructed by connecting more than three beams together. In a preferred embodiment, the three beams 5 are all the same length in order to provide for a more rigid structure. However, the length of the beams 5 may vary.

The beams 5 are preferably constructed from poles that have a sufficiently roughened and/or knotted outer surface that enable children to adequately grip the beams in order to facilitate climbing and maneuvering along the beams. The beams 5 should also be sufficiently rigid, yet flexible, in order to adequately support numerous children and/or adults positioned on the planar surfaces (15,15*a*), or the beams 5 themselves. The beams can be constructed from various materials, such as, but not limited to, metal, wood and composite plastics. As depicted in FIGS. 1 and 3A, an attachment means 38, such as a chain or the like, is fastened to the beams 5 by a bolt 39, or similar such fastening means, for securely joining the beams 5 together.

Figure 3B:
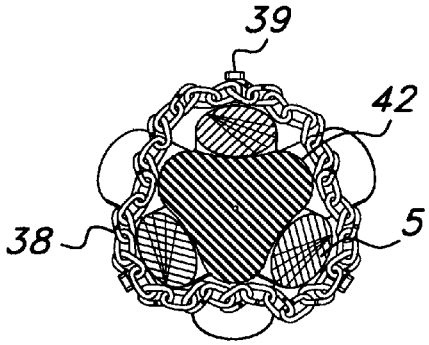
FIG. 3B is a top cross sectional view of the sloping beams and a contoured piece from FIG. 3A.

FIG. 3B depicts another preferred embodiment of the play and climbing equipment 1, wherein at vertex 10, the three beams 5 are supported, separated and equally spaced from one another by the contoured piece 42, preferably constructed of rubber. As shown in FIG. 3B the contoured piece 42 has three indentations because the play and climbing equipment 1 consists of three beams, and each of the three beam resides within a separate indentation. Bolts 39 are placed through the chain 38 and through the diameter of each beam 5 and into the center contoured piece 42. Each bolt 39 can be secured with a nut (not shown) for additional security and strength. Of course, it should be noted that there are numerous commercially available means well known to one skilled in the art that may be equally effective in securing the beams 5 to each other at vertex 10.

Figure 3C:
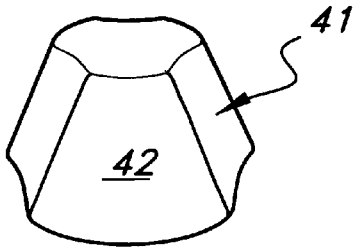
FIG. 3C is a perspective view of the contoured object used to stabilize the play and climbing structure according to the present invention.

FIG. 3C shows the tapered configuration and the indentations 41 of the contoured object 42. In a preferred embodiment, the contoured object 42 is approximately 18"–24" in length, as measured along its center vertical axis, however, the desired length of the contoured object 42 is determined by the dimensions of the climbing and play structure 1.

Flexible planar surfaces (15,15*a*), exemplified in the drawings as a net or webbed material, can be constructed from a variety of flexible materials. The flexible planar surfaces (15,15*a*) are preferably attached at corners 35 to each of the three beams 5 at attachment points 30. In a preferred embodiment shown in FIG. 1, each of the attachment points 30 on each beam 5 for the upper flexible planar surface 15 are positioned at equidistant locations from the top end 25 of each beam 5. Preferably, each of the attachment points 30 on each beam 5 for the lower flexible planar surface 15*a* are positioned at equidistant locations from the bottom end 25*a* of each beam 5. When the flexible planar surfaces (15*a*,15) are so arranged and drawn substantially taught, each run substantially parallel and horizontally to the ground surface on which the play equipment structure 1 is placed.

The attachment points 30 may also be located at randomly selected different distances from the ends of the beams 5. Placing the attachment points 30 at different heights along the beams 5 result in the flexible planar surfaces (15,15*a*) being at different angles relative to the surface the play equipment structure 1 is atop. This, of course, assumes that the beams 5 are each of substantially the same length; that the beams 5 slope at substantially the same angle with respect to one another; and that the play equipment structure 1 is atop a substantially flat surface or ground.

The corners 35 of the flexible planar surfaces (15,15*a*) may be joined to the beams 5 by various attachment devices 33 wrapped around the beam 5 and the corners 35 of the flexible planar surfaces (15,15*a*) as seen in FIG. 1. A bolt may be placed through the diameter of the beam 5 and through the attachment device 33 and fastened together by nut.

Figure 4:
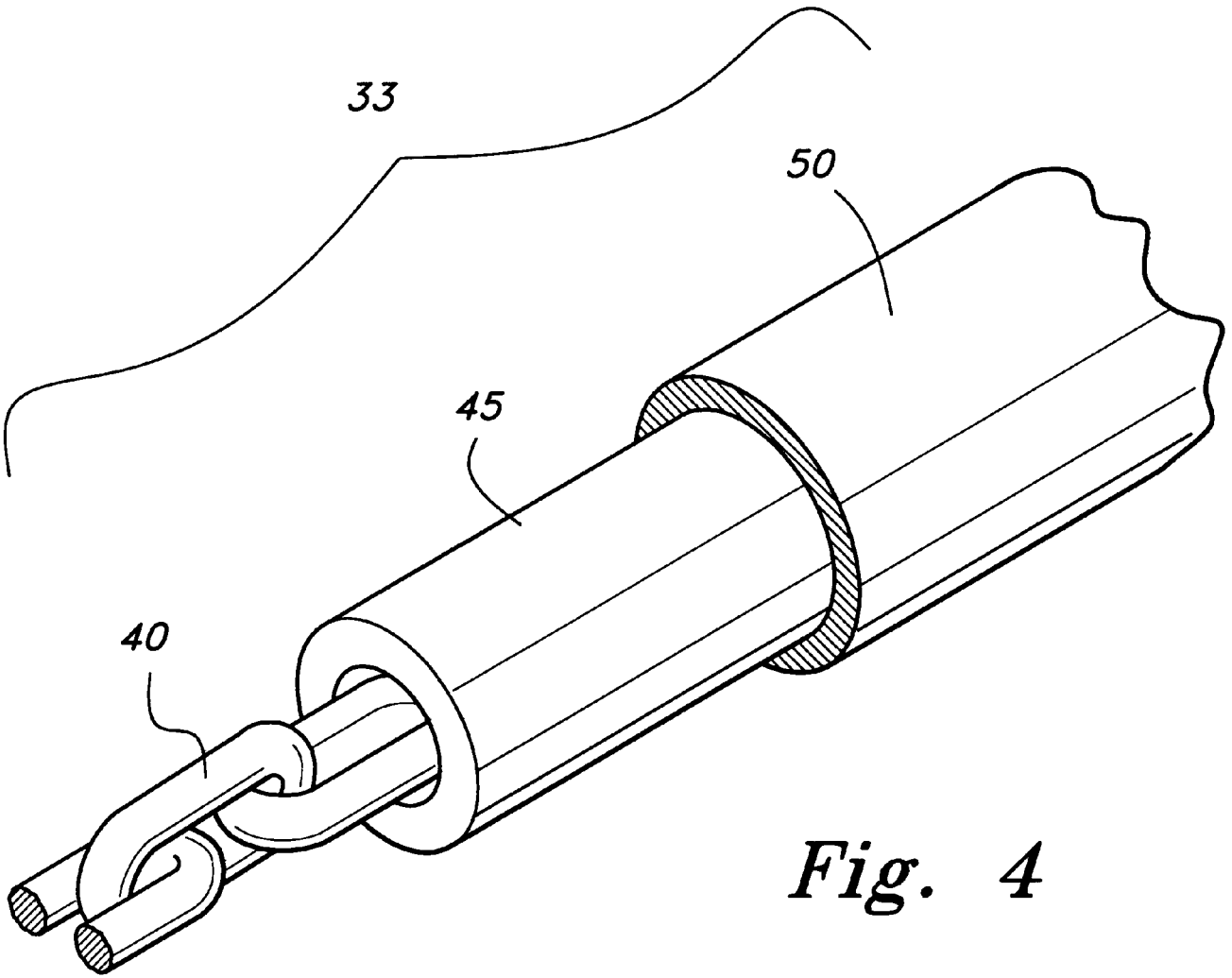
FIG. 4 shows an attachment device for securing the planar surface to the sloping beams.

In order to reduce abrasion and chafing that may be caused by the attachment device 33 rubbing against the flexible planar surfaces (15,15*a*) and the beams 5 when the attachment device 33 is a metal chain 40 or the like, the chain 40, as depicted in FIG. 4, may be covered with various polymeric or plastic materials such as nylon, or a nylon and polyester blend fabric layer 50, of the kind typically used in nylon based fire-hoses. As shown in FIG. 4, a more preferred embodiment for the attachment device 33 consists of placing the chain 40 in a conduit 45, such as a plastic sleeve, then covering the conduit 45 in a nylon blend fabric layer 50, such as a nylon fire-hose like material. It is believed that the conduit 45 helps to more evenly displace forces exerted by the chain 40 on the corners 35 of the planar surface (15,15*a*). There are numerous commercially available devices well to known to one skilled in the art that can be used to secure the corners 35 of the planar surfaces (15,15*a*) to the beams 5, for example, nylon fasteners that snap together "one time" can be used to permanently fasten the corners 35 to the beams 5.

In a preferred embodiment, the flexible planar surfaces (15,15*a*) have the same number of corners 35 as the number of beams 5 used to form the play equipment structure 1, and are constructed from the same material used to make the nylon blend fabric layer 50. Each corner 35 of the planar surfaces (15,15*a*) enables the planar surface to be attached to each beam. When the play equipment structure 1 consists of more than three beams, the planar surfaces (15,15*a*) may be shaped such that each has more than three corners 35 to enable each corner 35 to be connected to a different beam. However, every corner of the planar surfaces (15,15*a*) does not have to be connected to a beam, therefore the number of corners 35 on the planar surfaces (15,15*a*) do not necessarily have to correspond to the number of beams in the play equipment structure 1.

In the preferred embodiment shown in FIG. 1, the flexible planar surfaces (15,15*a*) cover substantially all of the surface area between the attachment points 30 on each beam 5. However, the amount of surface area the planar surfaces (15,15*a*) cover within, or even outside the polyhedral structure may vary. In addition, a planar surface constructed preferably from a rigid material may extend beyond one or all sides of the polyhedral structure, and other planar surfaces may be placed within the structure that only partially cover the surface area between the attachments points 30 on each beam 5 of the play and climbing equipment structure 1.

As seen in FIG. 1, the planar surfaces (15,15*a*) may be flexible and oriented in a downward bow shape or sagging position. The tautness in the planar surfaces (15,15*a*), the length of the attachment device 33 used to connect the planar surfaces (15,15*a*) to the beams 5, and distance between the beams are some of the factors that determine the amount of sag in the planar surfaces. The minimum distance between the beams 5, achieved by moving them towards one another, depends on the size and the location of contoured object 42 placed below the vertex 10. The contoured object 42 limits excessive inward movement of the beams 5. While the discussion of the preferred embodiment of the play equipment structure 1 is directed towards two planar surfaces (15,15*a*), it should be noted that the play equipment structure 1 can obviously have only one planar surface, or can have three or more planar surfaces.

As best seen in FIG. 2, the preferred embodiment of the planar surfaces (15,15*a*) consists of a net-like webbed triangular shaped pattern made of equilateral triangles. However, the shape and pattern of the planar surfaces (15,15*a*) may vary depending on the shape of the resulting polyhedral shaped play and climbing equipment structure 1. For example, a play and climbing equipment structure 1 having more than three beams 5 preferably has a planar surface with more than three corners in order to coincide with the greater number of beams and attachment points present.

As depicted in FIGS. 1, 3A, and 3C, the preferably tapered, contoured object 42, located within the interior of the support structure and under the vertex 10, is critical to the proper and safe functioning of the play equipment 1. By placing the contoured object 42 immediately under the vertex 10, excessive inward movement of the beams 5 towards one another is thereby limited.

The contoured object 42 can be constructed from a variety of materials, and is preferably made from a rubber based material. However, whatever type of material is chosen, the contoured object 42 should be capable of restricting the movement of the beams 5 from beyond the critical point that will lead to the collapse of the structure. The placement and design of the contoured object 42 should be such that excessive inward movement of beams 5 to a point that may cause the play equipment 1 to fall or collapse is prevented.

A polyhedral structure constructed of beams will collapse more easily when one or more of the beams that makeup the structure are brought toward the center of the structure. The movement of one or more beams towards the center of the structure shifts the center of gravity toward the other beams, thereby reducing the overall stability of the structure. Continued movement of the beams toward one another may eventually shift the center of gravity outside the structure. To prevent the collapse of the structure, the stabilizing contoured object 42 is preferably placed below the vertex 10 such that excessive inward movement of the beams is prevented.

When in use, the overall structural interactions between each component prevents the likelihood of collapse. For example, when a group of individuals climb upon planar surface 15*a*, the cumulative weight of such individuals may cause the ground contacting ends 25*a* of the sloping beams to be brought slightly inward, thereby causing the apex of the structure to rise slightly, wherein the resultant effect is a lowering of the planar surface 15*a* towards the ground. However, the planar surface 15*a* should preferably be positioned far enough above the ground in its resting state such that after receiving a heavy load, contact with the ground will occur before the structure becomes unstable. At such point, the individuals can simply exit the structure by stepping off the planar surface 15*a* directly onto the ground, thereby permitting the planar surface 15*a* to return to its original resting position. Moreover, another safety aspect of the current invention is the inherent flexibility of the sloping beams. For example, when an individual jumps up and down on the planar surfaces, the flexibility of the beams prevents a trampoline effect, which would otherwise be potentially dangerous and cause individual to be thrown from the planar surfaces.

The climbing and play structure of the present invention provides a safe and stimulating setting for a child to enjoy and have fun. The contoured object disposed beneath the vertex of the climbing and play structure helps to stabilize the climbing and play structure, and helps to reduce the potential danger of the structure collapsing. The multiple nets disposed at different heights make the climbing and play structure of the accessible to children from a wide range of ages.

It should be understood by those skilled in the art that various modifications and adaptations of the present invention, as well as alternative embodiments of the present invention, may be contemplated. The preferred embodiments of the present invention disclosed herein are intended to be illustrative only and are not intended to limit the scope of the invention. It is to be understood that the present invention is not limited to the embodiments described above, but encompasses any and all embodiments within the scope of the following claims.

I claim:

1. A climbing and play structure for positioning on a ground surface, the structure comprising:

a polyhedral shaped support structure having at least three sloping beams forming an interior region, wherein each of said beams has an upper portion having a top end and a lower portion having a bottom end;

a vertex formed where each of said at least three sloping beams intersects at said upper portions;

a first flexible substantially planar support surface located within said interior region of said support structure and attached to at least one of said sloping beams for supporting a user;

a stabilizing object disposed immediately beneath said vertex of said sloping beams within said interior region of said support structure;

said stabilizing object is a center contoured piece disposed beneath said vertex and having at least three indentations formed thereon, wherein each of said at least three beams reside within an indentation; and a chain wrapped around said beams and said center contoured piece for securing said beams and said center contoured piece together, wherein said chain and said center contoured piece are secured to said beams by bolts.

2. A climbing and play structure according to claim 1, further including:

a second flexible substantially planar support surface attached to at least one of said sloping beams for supporting a user.

3. A climbing and play structure according to claim 2, wherein:

each of said flexible substantially planar surfaces is webbed and have an equilateral triangular shape.

4. A climbing and play structure according to claim 1, wherein:

said polyhedral shape is a tetrahedron.

5. A climbing and play structure according to claim 1, further including:

an attachment device for connecting said first flexible substantially planar surface to said beams comprising;

a chain;

a conduit covering said chain; and a layer of nylon material covering said conduit.

6. A climbing and play structure comprising:

a support structure having a tetrahedral shaped configuration containing at least three sloping beams forming an interior region, wherein each of said beams has an upper portion having a corresponding a top end and a lower portion having a corresponding bottom end;

each of said beams are approximately 18 feet in length and approximately 8 inches in diameter;

a vertex formed where each of said three sloping beams intersects at said upper portions;

a center contoured piece disposed beneath said vertex and having at least three indentations formed thereon, wherein each of said beams reside within an indentation;

a chain wrapped around said beams and said center contoured piece for securing said beams and said center contoured piece together;

said chain and said center contoured piece is secured to said beams by bolts;

a first net and a second net horizontally disposed within the interior region of said support structure; and each of said first net and said second net are attached to said three sloping beams, wherein said first net is approximately 12 feet above ground level, and said second net is approximately 6 feet above the ground level.

7. A climbing and play structure according to claim 6, wherein:

said first and second net each comprise a nylon fabric.

8. A climbing and play structure according to claim 7, wherein:

said contoured piece comprises rubber.

* * * * *